US012366119B2

(12) United States Patent
Ramchune et al.

(10) Patent No.: US 12,366,119 B2
(45) Date of Patent: Jul. 22, 2025

(54) DETECTION OF HEAT GENERATED BY CUTTING ACTION OF A DRILL BIT

(71) Applicant: Chevron U.S.A. Inc., San Ramon, CA (US)

(72) Inventors: Devanand Ramchune, Humble, TX (US); David Charles Myerson, Houston, TX (US); Thomas William Chase, Houston, TX (US); William Penaloza, The Woodlands, TX (US); Joseph William Hughes, Cypress, TX (US); Matthew David Hays, Houston, TX (US); Kevin Reid, Houston, TX (US); Scott James Stamper, Houston, TX (US); Afshin Babaie Aghdam, Houston, TX (US); Aaron Schen, Conroe, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/422,714

(22) Filed: Jan. 25, 2024

(65) Prior Publication Data

US 2024/0247549 A1 Jul. 25, 2024

Related U.S. Application Data

(60) Provisional application No. 63/481,520, filed on Jan. 25, 2023.

(51) Int. Cl.
*E21B 10/62* (2006.01)
*E21B 47/07* (2012.01)

(52) U.S. Cl.
CPC ..... *E21B 10/62* (2013.01); *E21B 47/07* (2020.05)

(58) Field of Classification Search
CPC ..... E21B 10/62; E21B 47/07; E21B 47/013
See application file for complete search history.

(56) References Cited

U.S. PATENT DOCUMENTS

| | | | | |
|---|---|---|---|---|
| 1,702,685 A * | 2/1929 | Dalrymple | G01K 5/32 374/E5.019 |
| 2,633,025 A * | 3/1953 | Boice | E21B 47/07 374/E5.019 |
| 3,802,269 A * | 4/1974 | Cooper | E21B 47/013 374/162 |
| 2014/0231142 A1 * | 8/2014 | Poitzsch | E21B 10/00 175/50 |

FOREIGN PATENT DOCUMENTS

| | | | |
|---|---|---|---|
| WO | WO-2024091274 A1 * | 5/2024 | E21B 10/43 |

* cited by examiner

*Primary Examiner* — James G Sayre
(74) *Attorney, Agent, or Firm* — Avery L. Cate

(57) ABSTRACT

A temperature plug assembly, a drill bit including a temperature plug assembly, and a method of manufacturing a drill bit having a temperature plug assembly are provided. The temperature plug assembly includes a plug base and a temperature indicator. The plug base has a first end, a second end opposite the first end, and an intermediate portion extending between the first end and the second end. The temperature indicator is disposed along the first end of the plug base.

23 Claims, 10 Drawing Sheets

DETECTION OF HEAT GENERATED BY CUTTING ACTION OF A DRILL BIT

CROSS REFERENCE TO RELATED APPLICATION

This application claims the benefit of U.S. Provisional Patent Application No. 63/481,520, filed on Jan. 25, 2023, the entirety of which is incorporated herein by reference.

TECHNICAL FIELD

The present invention is directed to methods and devices for detecting heat generated by the cutting action of a drill bit while drilling a wellbore in a subterranean formation, and more particularly, to measuring temperatures closest to a bit face of a polycrystalline diamond compact (PDC) drill bit.

BACKGROUND

While utilizing earth penetrating tools, including PDC drill bits, heat may be generated due to friction while rotating during drilling operations. In some instances, high bit speeds during drilling can generate additional heat, and subsequently elevated temperatures, that may result in a variety of undesirable physical and chemical phenomena that could affect the polycrystalline diamond (PCD) cutters on the PDC drill bit, the bit body, as well as the drilling fluid. For example, at sufficiently high temperatures, gases typically not found native to the formation (such as $H_2S$ and $CO_2$) may be generated during drilling. This phenomenon may also lead to difficulties in the evaluation of wellbore lithology. Having an understanding of the temperature(s) that the drill bit face(s) are exposed to during drilling can help to better understand the borehole structure and shape completions operation plans (e.g., design better downhole fluids, higher thermally stable PCD cutters on the PDC drill bits, select appropriate material for completions, etc.) after drilling operations are completed.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF THE DRAWINGS

Figure 1A:
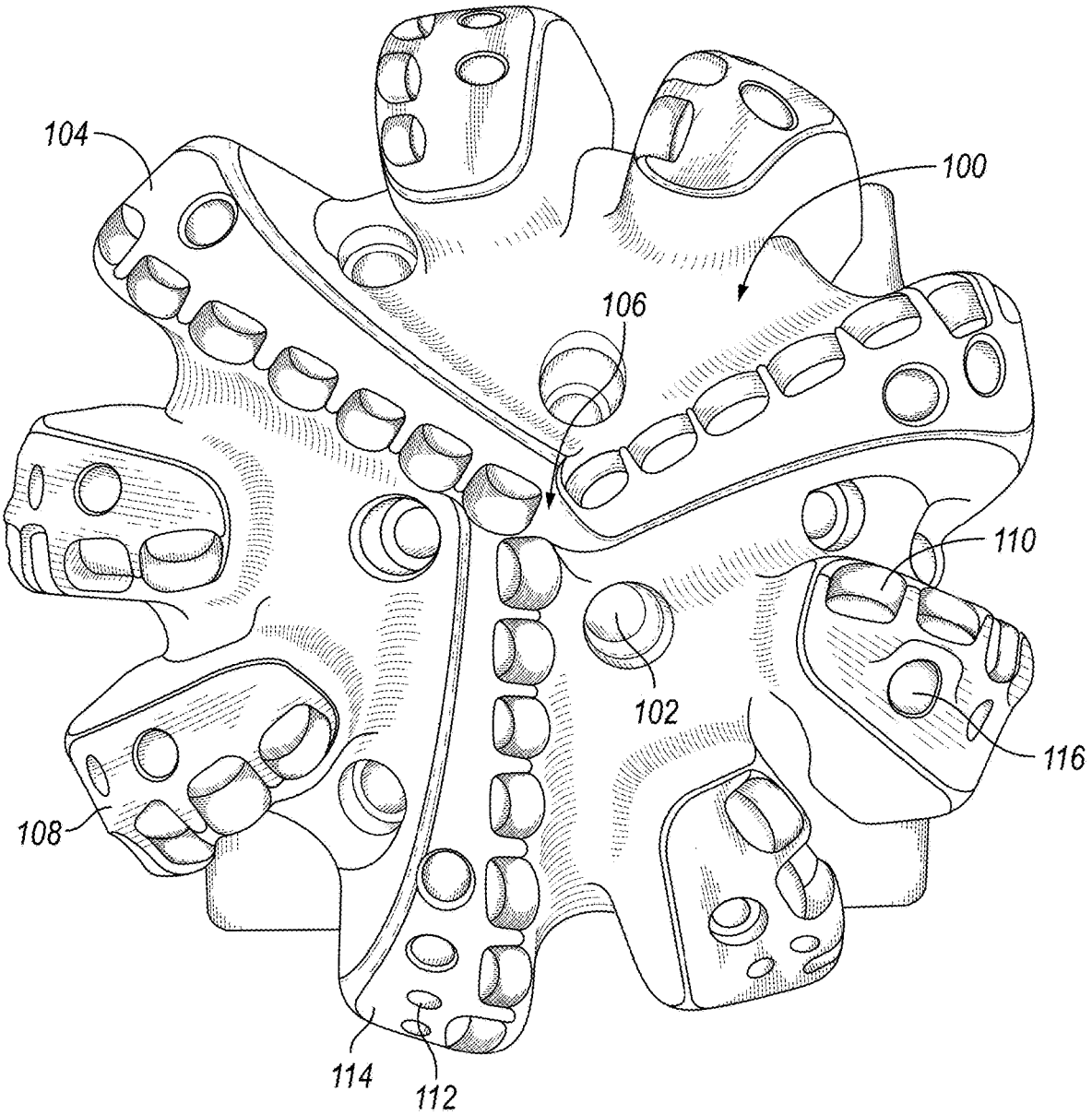
FIG. 1A illustrates a PDC drill bit, prior to brazing and installation of additional components, according to an exemplary embodiment.

The example embodiments discussed herein are directed to systems, apparatus, and methods related to earth penetrating tools, such as PDC drill bits, having at least one temperature gauge therein. The subterranean resources captured using example embodiments may include, but are not limited to, oil and natural gas. Creating one or more wellbores using example embodiments and/or using such wellbores with example embodiments may be designed to comply with certain standards and/or requirements. Example embodiments may be used for wellbores drilled in conventional and/or unconventional (e.g., tight shale) subterranean formations and reservoirs.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, unconventional (e.g., a having permeability of less than 25 millidarcy (mD) such as a permeability of from 0.000001 mD to 25 mD), diatomite, geothermal, mineral, etc. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geosteering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof. In some embodiments, the same control devices may be used to control fluid flow into and out of the well. In some embodiments, different control devices may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure may be inferred to that component. Conversely, if a component in a figure is labeled, but not described, the description for such component may be substantially the same as the description for the corresponding component in another figure. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of earth penetrating tools and associated methods will be described more fully hereinafter with reference to the accompanying drawings, in which example embodiments of drill bits are shown. Earth penetrating tools may, however, be embodied in many different forms and should not be construed as limited to the example embodiments set forth herein. Rather, these example embodiments are provided so that this disclosure will be thorough and complete, and will fully convey the scope of earth penetrating tools to those of ordinary skill in the art. Like, but not necessarily the same, elements (also sometimes called components) in the various figures are denoted by like references for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of earth penetrating tools. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 7:
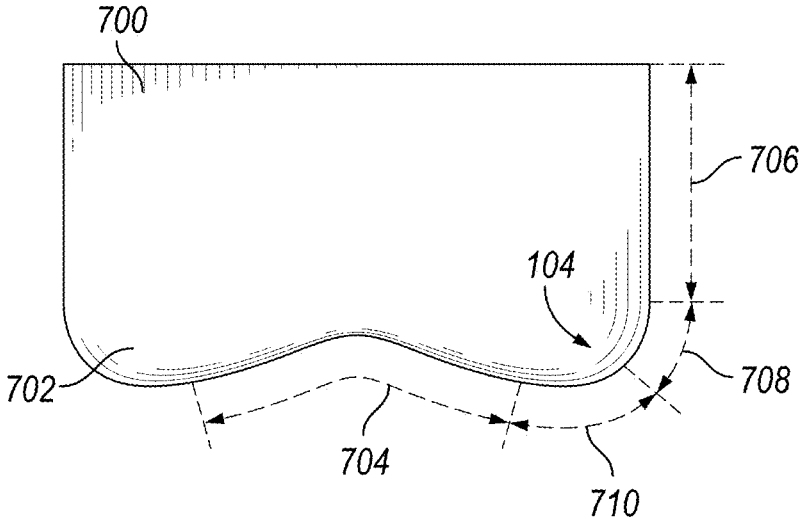
FIG. 7 is a side schematic view of a PDC drill bit illustrating a bit profile, according to an exemplary embodiment.

FIG. 1A illustrates a PDC drill bit frame 100, prior to brazing and installation of additional components to form a PDC drill bit, according to an exemplary embodiment. The PDC drill bit frame 100 includes a plurality of openings 102 extending therethrough, into which nozzles (for drilling fluids delivery) can be inserted. The PDC drill bit frame 100 also includes a series of primary blades 104 positioned about the frame and extending toward or to a center 106 of the bit, and a series of secondary blades 108 that are positioned between the primary blades 104 (and do not extend to the center 106 of the bit). In the illustrated embodiment, the drill bit frame 100 has three primary blades 104 and six secondary blades 108. However, the number of blades 104, 108 can vary on a drill bit and may be determined based on a drilling application, which may include, but is not limited to, formation drillability, vibration control, directional control, bit face cleaning, etc. Each blade 104, 108 includes a plurality of grooves 110, or layout of pockets, at a face of the blade into which PCD cutters can be installed. Each blade 104, 108 may also include a plurality of openings 112 for depth of cuts limiters arranged from a cone portion to a gauge portion 114 on the profile of the drill bit. An example "profile" of a drill bit is described in greater detail below with respect to FIG. 7, showing at least one blade 104 having a cone portion, a nose portion, a shoulder portion, and a gauge portion.

In certain exemplary embodiments, the drill bit frame 100 includes an opening 116 formed therein. For example, as shown in FIG. 1A, the one or more blades 104, 108 of the PDC drill bit may each include an opening 116. These openings 116 are designed to receive a temperature tab insert, or temperature plug, as described further with respect to FIGS. 4A, 4B, and 5.

As shown, each opening 116 may be positioned behind the cutters (e.g., behind the grooves 110) of the corresponding blade 104, 108 with respect to the direction for rotation of the drill bit. As such, the opening(s) 116 will "follow" the cutters as the drill bit turns to drill a wellbore. As shown, each opening 116 may be positioned above the gauge/depth of cuts limiters (e.g., above the gauge portion 114 and/or openings 112) of the corresponding blade 104, 108. That is, the opening 116 may be located closer to the center 106 of the bit than the depth of cuts limiter openings 112. The opening 116 may be formed in a nose portion of the blade 104, 108, as described with reference to the bit profile in FIG. 7. As illustrated, the openings 116 in each of the blades 104, 108 may be approximately the same distance (in a radial direction) away from the center 106 of the drill bit, regardless of a distance in which the individual blades (e.g., primary vs. secondary blades) extend radially toward the center 106 of the drill bit.

In certain embodiments, the openings 116 are generally cylindrical. However, one having ordinary skill in the art will recognize that these openings 116 can have any shape designed to receive a corresponding shaped temperature plug. For instance, the shape can be substantially rectangular, rectangular with rounded edges, elliptical, or any other shape that allows for retention using a fastener (e.g., screws, pins, threads, snap rings, etc.).

Figure 1B:
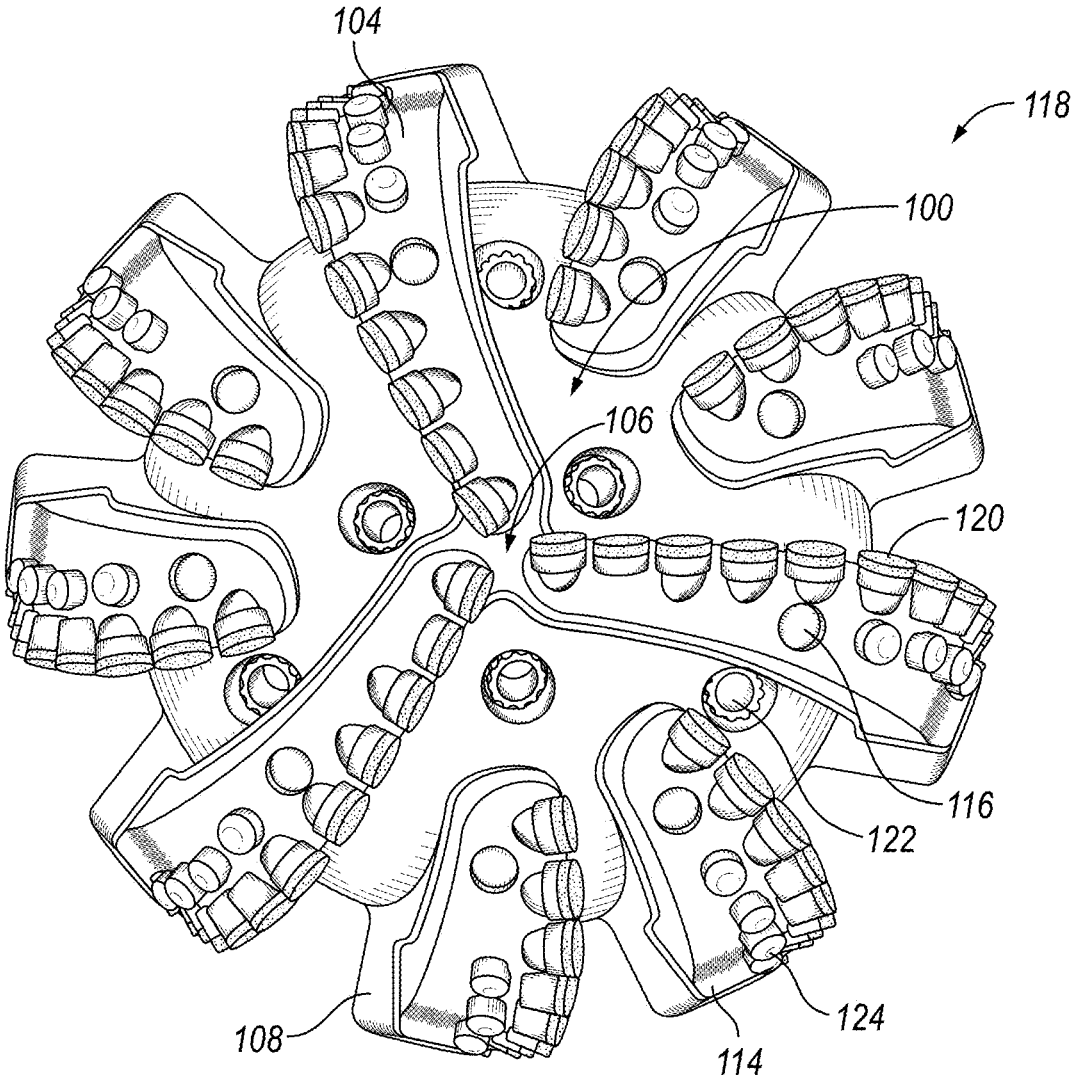
FIG. 1B illustrates a finished PDC drill bit, after brazing and installation of additional components, according to an exemplary embodiment.

FIG. 1B illustrates a finished 10⅝ inch design PDC drill bit 118, which includes the drill bit frame 100 after installation of additional components, according to an exemplary embodiment. The finished PDC drill bit 118 includes a plurality of cutters 120 inserted into the pockets for cutters (e.g., 110 of FIG. 1A), nozzles 122 in the openings for nozzles (e.g., 102 of FIG. 1A), and depth of cuts limiters 124 inserted into the gauge 114 of each blade 104, 108.

Figure 2:
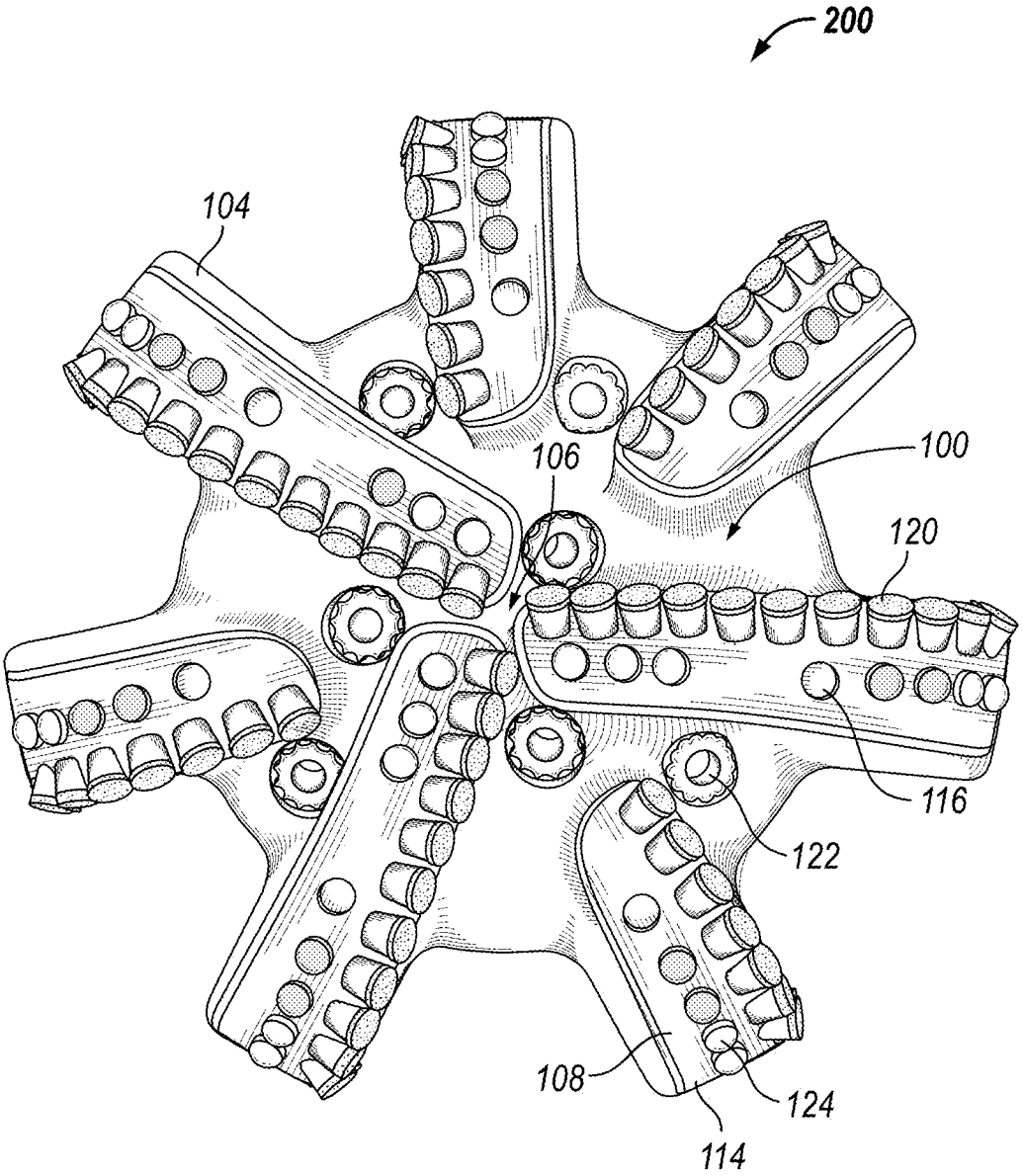
FIG. 2 illustrates a finished PDC drill bit, according to another exemplary embodiment.

FIG. 2 illustrates a finished 12¼ inch design PDC drill bit 200, according to another exemplary embodiment. The drill bit 200 of FIG. 2 is substantially similar to the drill bit 118 of FIG. 1B, except as described below. For the sake of brevity, the similarities will not be repeated hereinbelow. The drill bit 200 varies in the number of secondary blades 108 (four instead of six), as well as the number, size, and shape of the cutters 120. In addition, the drill bit 200 includes fewer openings 116 for receiving temperature plugs.

Figure 3A:
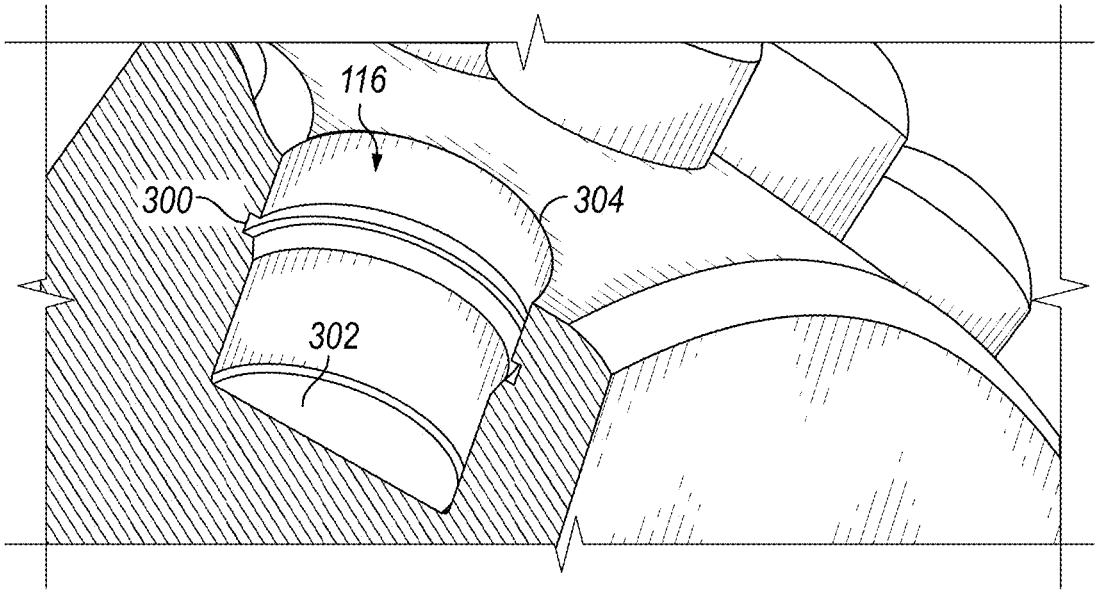
FIG. 3A is a close-up, cutaway view of an opening in a drill bit body for receiving a temperature plug, according to an exemplary embodiment.
Figure 3B:
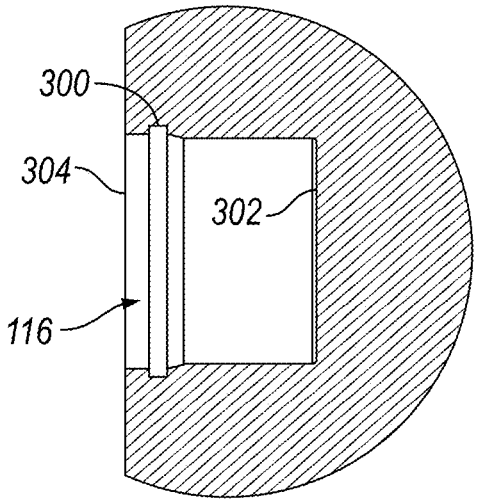
FIG. 3B is a close-up, side cross-sectional view of the opening of FIG. 3A, according to an exemplary embodiment.

FIG. 3A is a close-up, cutaway view of the opening 116 for receiving a temperature plug, according to an exemplary embodiment. FIG. 3B is a close-up, side cross-sectional view of the opening 116 of FIG. 3A. The opening 116 is generally cylindrical and includes a flat bottom 302 upon which the bottom of a temperature plug (shown in FIG. 4B) can sit. The opening 116 also includes a groove 300 for receiving a snap ring (shown in FIGS. 6A and 6B) for keeping the temperature plug retained therein and preventing the temperature plug from coming out downhole. As illustrated, the groove 300 is formed into the drill bit frame 100 along an edge of the opening 116 in the drill bit frame 100. As shown, the groove 300 may be formed at a position along an axial length of the opening 116 that is distanced from the upper edge 304 of the opening 116. This allows the temperature plug to be recessed within the opening 116 and thus kept out of the way of any debris surrounding the drill bit. In other embodiments, the groove 300 may be located closer to and/or immediately proximate to the upper edge 304 of the opening 116.

Figure 4B:
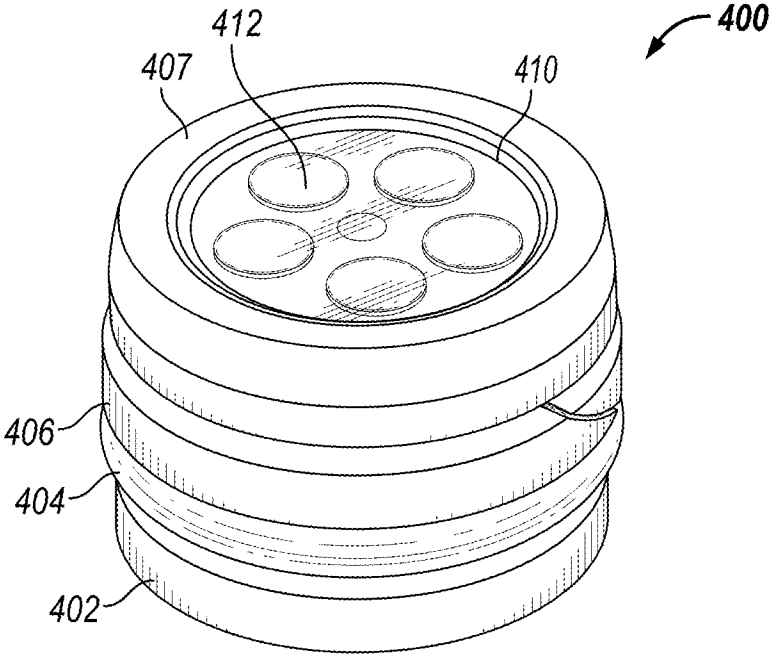
FIG. 4B is a bottom, perspective view of the temperature plug of FIG. 4A, according to an exemplary embodiment.
Figure 4A:
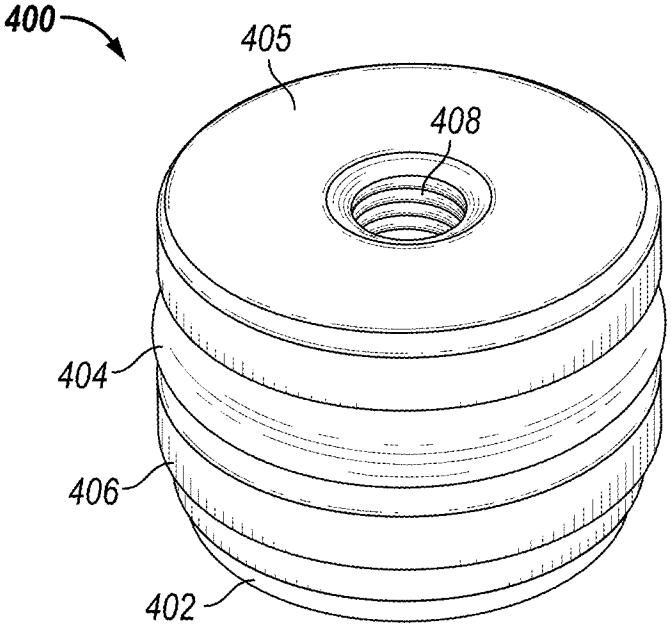
FIG. 4A is a top, perspective view of a temperature plug for insertion into a temperature plug opening of a drill bit, according to an exemplary embodiment.

FIGS. 4A and 4B are respective top and bottom perspective views of a temperature plug 400 for insertion into the temperature plug opening (e.g., 116 of FIGS. 1A-3B) of an exemplary drill bit of the present invention. The temperature plug 400 includes at least a plug base 402 and a sealing element, such as an O-ring 404. In certain alternative embodiments, the sealing element may be an elastomer or a metal gasket. As illustrated, the temperature plug 400 may also include a retaining ring 406. In certain exemplary embodiments, the plug base 402 may include a top end 405, a bottom end 407, and an intermediate portion extending between the top end 405 and the bottom end 407. The intermediate portion of the plug base 402 may be a groove about the body of the plug base 402 for receiving the O-ring 404 and the retaining ring 406. The plug base 402 may include an aperture 408 (shown in FIG. 4A) at the top end 405 of the plug base 402. The aperture 408 extends from the top end 405 of the plug base 402 at least partially through the plug base 402. The aperture 408 may be threaded, thus providing a screw hole through the plug base 402.

In certain exemplary embodiments, the temperature plug 400 includes a temperature indicator, such as a temperature tag 412 (shown in FIG. 4B) disposed proximate the bottom end 407 of the plug base 402. A temperature tag 412 may take the form of a sticker or label that is applied to the plug base 402. The temperature tag 412 is configured to visually change (e.g., changing color in certain regions of the tag) in response to exposure to temperatures above a predetermined temperature threshold or within a predetermined temperature range. As shown, the plug base 402 may include a recess 410 (shown in FIG. 4B) at the bottom end 407 of the plug base 402 for receiving the temperature tag 412. In certain embodiments, the recess 410 at the bottom end 407 of the plug base 402 can further include a temperature indicating paint that changes color based on temperature exposure. Generally, after insertion of a temperature tag 412, additional room in the recess area 410 can be filled up with the temperature indicating paint during final installation of the drill bit. For example, temperature indicating paint can be dabbed into the temperature plug opening (e.g., 116 of FIGS. 1A-3B) of the drill bit first, then the temperature plug 400 can be inserted therein. In yet other embodiments, other types of temperature indicators (e.g., thermocouples, semiconductor-type temperature sensors) and/or a vibration sensor can be placed inside the recess 410 of the plug base 402.

The aperture 408 at the top of the plug base 402 is configured to receive an extraction bolt (shown in FIG. 5), which is utilized to insert or remove the temperature plug 400 from its corresponding opening (e.g., 116 of FIGS. 1A-3B). The O-ring 404 and the retaining ring 406 may aid in sealing the temperature plug 400 within the opening. The temperature tag 412 may aid in determining the temperatures reached closest to the cutter face of a drill bit while drilling.

In certain embodiments, the temperature tag 412 may indicate a range of temperatures to which the tag is exposed. Generally, the temperature tags 412 are non-reversible temperature labels that are irreversible once the temperature change occurs and causes the label to trigger. Generally, the temperature labels can detect temperatures in the range from about 240 to about 500 degrees Fahrenheit. In certain embodiments, one or more temperature labels can detect temperatures in the range from about 240 to about 280 degrees Fahrenheit. In certain embodiments, one or more temperature labels can detect temperatures in the range from about 290 to about 330 degrees Fahrenheit. In certain embodiments, one or more temperature labels can detect temperatures in the range from about 340 to about 380 degrees Fahrenheit. In certain embodiments, one or more temperature labels can detect temperatures in the range from about 390 to about 435 degrees Fahrenheit. In certain embodiments, one or more temperature labels can detect temperatures in the range from about 450 to about 500 degrees Fahrenheit. One having ordinary skill in the art will recognize that the temperature range exposures may vary from blade to blade on a single drill bit during a single drilling application. For example, one blade may be exposed to temperatures from about 450 to about 500 degrees Fahrenheit, while another blade may be exposed to temperatures from about 390 to about 435 degrees Fahrenheit during the same run. In certain alternate embodiments, openings for receiving temperature plugs may be positioned further away from the cutter faces, towards the gauge section, to determine a range of temperatures that the drill bit is exposed to. In certain embodiments, as heat is a contributing factor in PCD cutter breakdown, understanding the heat signature from cone to gauge on the profile may influence bit design for future applications. As discussed above, temperature tags having different sensitive temperature ranges may be placed in different openings within the same drill bit, thus allowing the temperature sensors to accurately detect temperature exposures across the drill bit during drilling operations.

Turning back to FIGS. 1A-2, the multiple temperature plugs located in the different openings 116 along the drill bit frame 100 may be configured to detect temperatures within the same or different temperature ranges from each other. For example, the openings 116 in one or more of the blades 104, 108 may be fitted with temperature plugs having a first temperature sensing range, while the openings 116 in another one or more of the blades 104, 108 may be fitted with temperature plugs having another temperature sensing range. Each of the openings 116 in the blades 104, 108 of the drill bit may be fitted with different temperature range sensitive temperature plugs in certain embodiments. In other embodiments, each temperature plug installed in the blades 104, 108 may have the same temperature range. In still other embodiments, some of the temperature plugs installed in the blades 104, 108 may have the same temperature range while others have different temperature ranges. For example, one each of temperature plugs having relatively lower temperature ranges (e.g., 240-280 degrees Fahrenheit, 290-330 degrees Fahrenheit, 340-380 degrees Fahrenheit) may be installed in corresponding openings 116 of the drill bit, while one or more pairs of temperature plugs having higher temperature ranges (e.g., 390-435 degrees Fahrenheit, 450-500 degrees Fahrenheit) may be installed in corresponding pairs of openings 116 of the drill bit to provide redundancy for these larger temperature measurements. Pairs of redundant temperature plugs having the same temperature range may be positioned in openings 116 that are approximately 180 degrees from each other circumferentially around the drill bit. It will be understood that any other configuration of redundant temperature plugs may be used in other embodiments.

Figure 5:
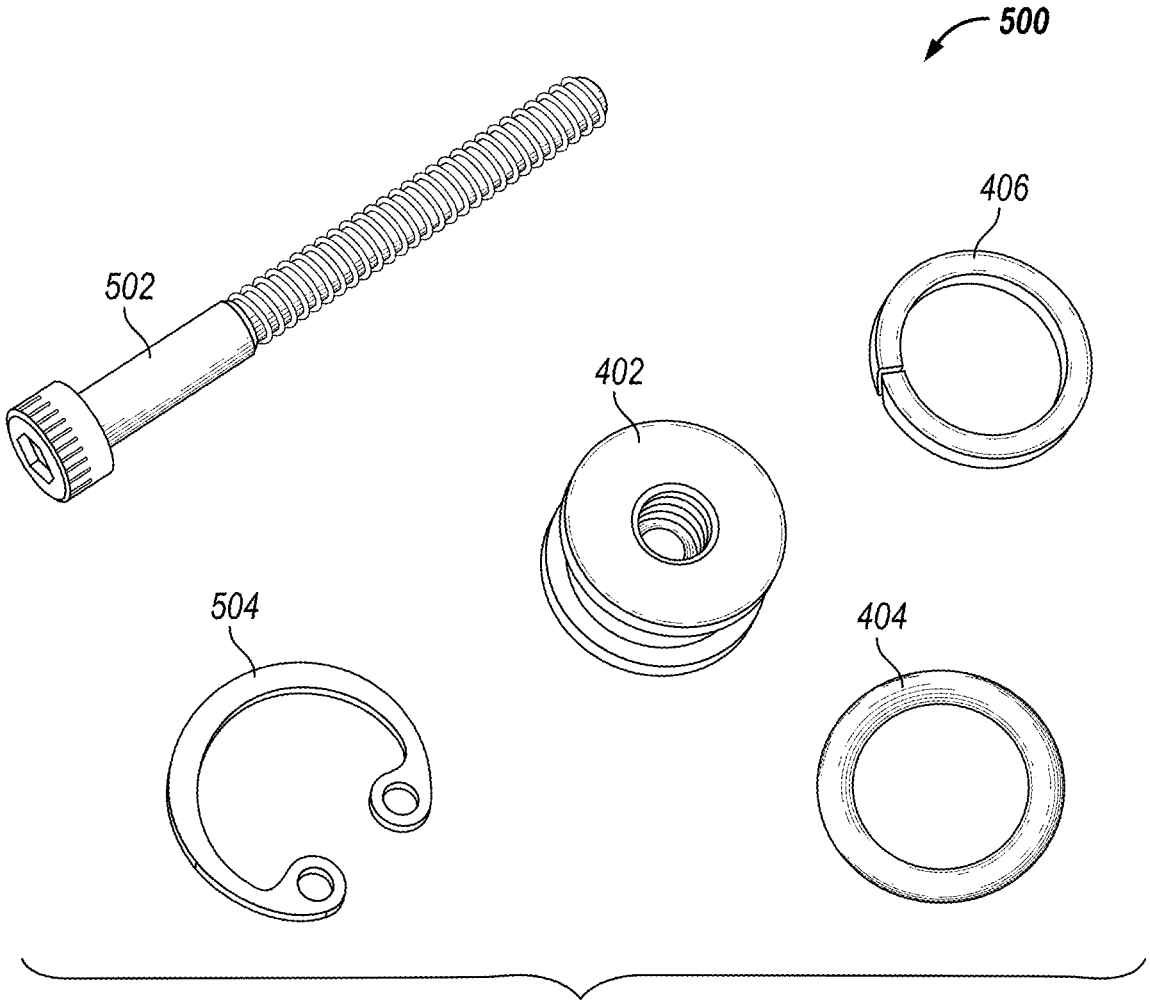
FIG. 5 is an exploded view of a temperature plug assembly for inserting into or extracting from the temperature plug opening on a drill bit, according to an exemplary embodiment.

FIG. 5 is an exploded view of a temperature plug assembly 500 for insertion into or extraction from the openings (e.g., 116 of FIGS. 1A-3B) for a temperature plug on a drill bit, according to an exemplary embodiment. The temperature plug assembly 500 may include the plug base 402, the O-ring 404, the retaining ring 406, an extraction bolt 502, and a snap ring 504. As discussed above, the extraction bolt 502 may be used to insert and/or remove the assembled temperature plug from the opening for the temperature plug. The snap ring 504 is configured to be selectively compressed in a radial direction for placement into the opening (e.g., 116 of FIGS. 1A-3B) for the temperature plug and then radially expanded into the groove (e.g., 300 of FIGS. 3A-3B) to secure the temperature plug within the opening. The snap ring 504, in its radially expanded position, has an inner diameter that is smaller than an outer diameter of the top end (e.g., 405 of FIG. 4A) of the plug base 402, thus enabling the snap ring 504 to secure the temperature plug within the opening.

Figure 6A:
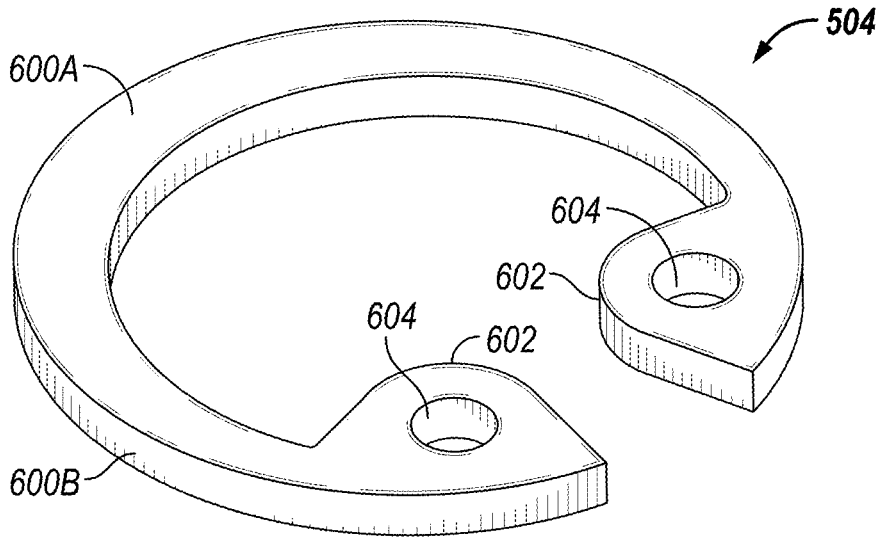
FIG. 6A is a top, perspective view of a snap ring for keeping a temperature plug retained within an opening in a drill bit, according to an exemplary embodiment.
Figure 6B:
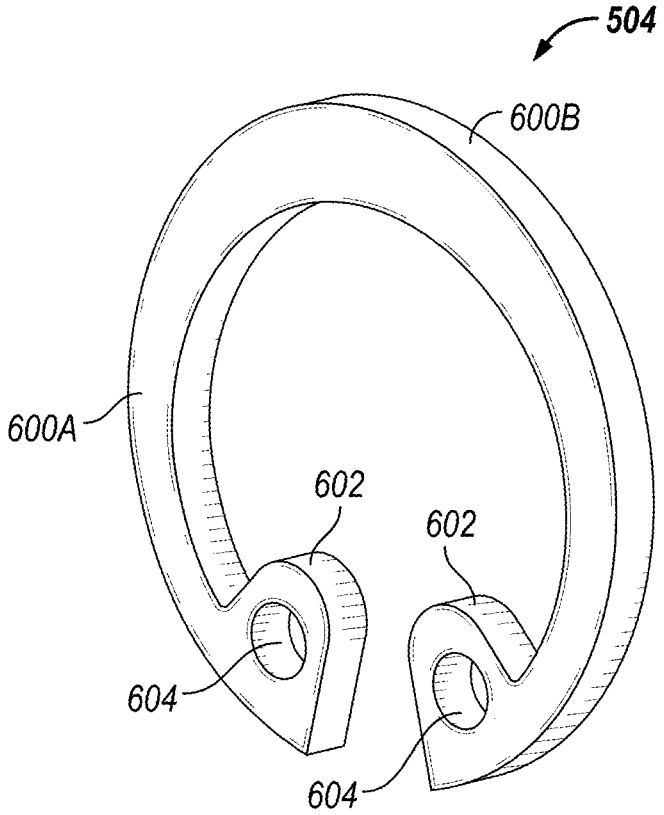
FIG. 6B is a side, perspective view of the snap ring of FIG. 6A, according to an exemplary embodiment.

FIGS. 6A and 6B are perspective views of the snap ring 504 for keeping a temperature plug (e.g., 400 of FIGS. 4A and 4B) retained within an opening in a drill bit, according to an exemplary embodiment. The snap ring 504 may include a substantially flat surface 600A on a side facing the temperature plug and a substantially flat surface 600B on an opposite side facing away from the temperature plug. For example, as shown, the snap ring 504 includes a flat surface 600A/B on both sides that will sit flush with opposite surfaces of the groove (e.g., 300 of FIGS. 3A-3B). Therefore, there is no installation risk of the snap ring 504 leaving its respective groove (when compared to a snap ring with a curved side). In addition, the flat surface 600A may sit flush with the top surface (e.g., 405 of FIG. 4A) of the temperature plug. The snap ring 504 may be a discontinuous ring with two ends proximate each other. In certain embodiments, the snap ring 504 includes a projection 602 at each end, with each projection 602 containing a hole 604 formed therethrough. These holes 604 are configured to receive snap ring pliers (not shown) during the installation and removal processes. Snap ring pliers may be engaged with the holes 604 and used to pull the projections 602 towards each other to reduce the radius of the snap ring 504, thus enabling installation and removal of the snap ring 504 from the opening.

FIG. 7 is a schematic side view of a PDC bit body 700, which includes a PDC bit profile 702, according to an exemplary embodiment. As seen in the figure, the profile 702 of the bit body 700 follows different regions of cutter placement and/or locations along a blade 104 of the bit body 700. For example, the profile 702 shows a cone portion 704 toward a center of the bit body 700, as well as a gauge portion 706, a shoulder portion 708, and a nose portion 710 of the blade 104. The temperature plug(s) described above may be positioned within one or more blades 104 of the bit body 700 at a location atop the blade 104 (e.g., a location corresponding to the nose portion 710 of the blade 104). In certain embodiments, one or more temperature plug(s) may be positioned within one or more blades 104 of the bit body 700 at a location along the cone portion 704 of the blade 104.

Figure 8:
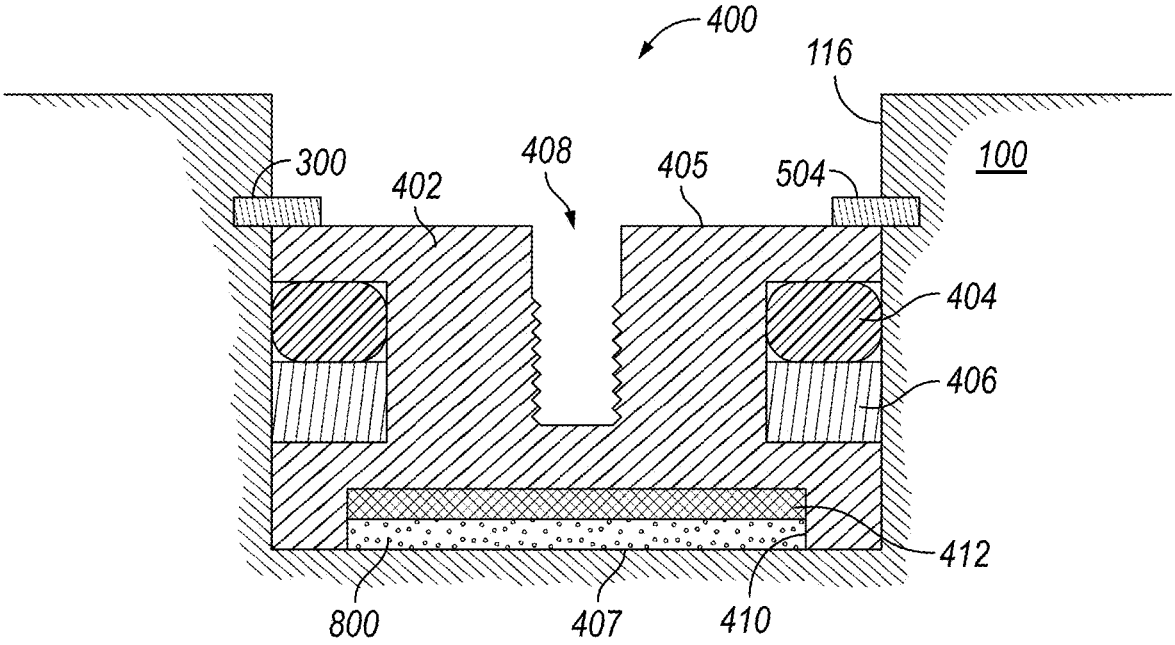
FIG. 8 is a side cross-sectional view of the temperature plug located in the opening of a drill bit, according to an exemplary embodiment.

FIG. 8 is a side cross-sectional view of a temperature plug 400 installed into a drill bit frame 100, according to an exemplary embodiment. As illustrated, the temperature plug 400 may be disposed within the opening 116 of the drill bit frame 100. The bottom end 407 of the temperature plug 400 may enter the opening 116 before the top end 405 of the temperature plug 400 during insertion of the temperature plug 400 in the opening 116. As discussed at length above, the temperature plug 400 may include the plug base 402, a sealing element (such as the O-ring 404) and the retaining ring 406 disposed around the intermediate portion of the plug base 402, and the temperature tag 412. An aperture 408 (e.g., threaded aperture) extends through a portion of the plug base 402. This aperture 408 may assist with the insertion and removal of the temperature plug 400 from the drill bit frame 100. A layer of temperature indicating paint 800 may be disposed between the bottom end 407 of the plug base 402 and an end or "bottom" of the opening 116 within the drill bit frame 100. The temperature indicating paint 800 may be located in the remainder of the recess 410 at the bottom end 407 of the temperature plug 400. The temperature indicating paint 800 may provide another indication of temperatures encountered at the drill bit during drilling operations after removal of the temperature plug 400 for inspection. As illustrated, the snap ring 504 may be disposed within the groove 300 formed along the opening 116 above the temperature plug 400. Thus, the snap ring 504 can hold the temperature plug 400 between the groove 300 and the bottom of the opening 116 within the drill bit frame 100.

While a snap ring is used to retain the temperature plug inside the opening in the illustrated embodiment, it should be noted that other types of retention assemblies may be used in other embodiments. For example, other embodiments may use a flange on the temperature plug that is bolted to a recessed shoulder of the opening; a collet mechanism formed between or separately coupled between the temperature plug and the opening; one or more detents or grooves and corresponding projections along the temperature plug/opening; or any other mechanism for retaining a plug in an opening. In still other embodiments, the snap ring may be positioned partially within a recess in the temperature plug, instead of above the temperature plug.

Figure 9:
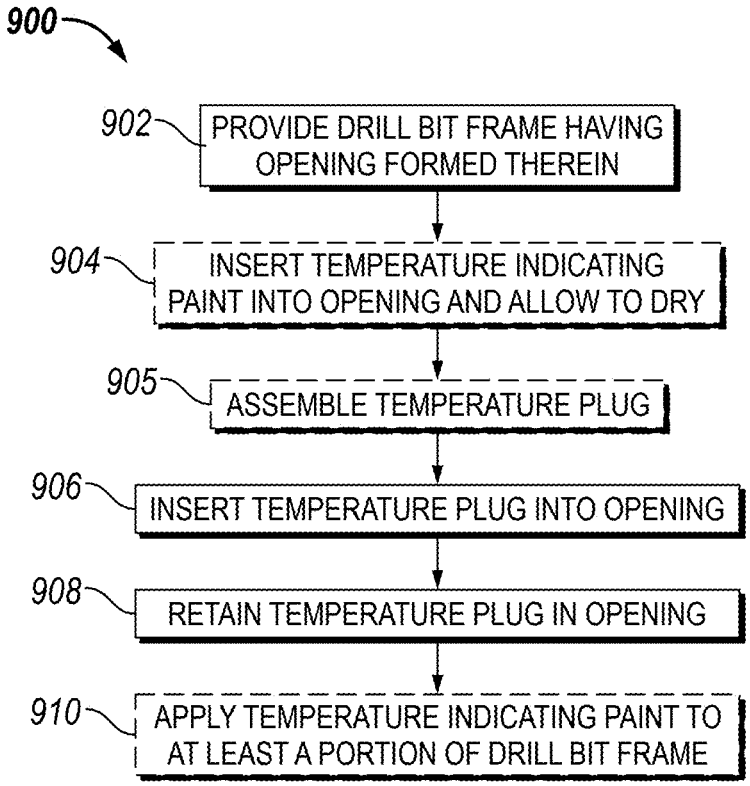
FIG. 9 is a process flow diagram illustrating a method of manufacturing a drill bit, according to an exemplary embodiment.

FIG. 9 is a process flow diagram of a method 900 of manufacturing a drill bit, in accordance with an exemplary embodiment. At block 902, the method 900 includes providing a drill bit frame (e.g., 100 of FIG. 8) with an opening (e.g., 116 of FIG. 8) formed therein. At block 904, the method 900 may include inserting temperature indicating paint (e.g., 800 of FIG. 8) into the opening and allowing the paint to dry. At block 905, the method 900 may include assembling the temperature plug (e.g., 400 of FIG. 8). This may include installing the temperature tag onto the plug body, installing the sealing element, such as an O-ring, about the plug body, and/or installing the retaining ring about the plug body. At block 906, the method 900 includes inserting the temperature plug in the opening. At block 908, the method 900 includes retaining the temperature plug in the opening. Block 908 may include, for example, inserting a snap ring (e.g., 504 of FIG. 8) into a groove (e.g., 300 of FIG. 8) formed along the opening to retain the temperature plug within the opening. At block 910, the method 900 may include applying temperature indicating paint (e.g., 1002 of FIG. 10) to at least a portion of the drill bit frame.

Exemplary methods of the present application include a method of installing a temperature plug into an opening, or port, within a drill bit. This method may accomplish the steps outlined in blocks 904-908 of FIG. 9. Generally, each opening, or port, is cleaned with a solvent until no more debris is observed on cleaning cloth. In certain exemplary embodiments, the bottom of each port is painted with temperature indicating paint and allowed to dry (block 904), typically about 2-4 hours. Each port is cleaned again with a solvent until no more debris is observed on cleaning cloth. The top of each plug is labelled, typically with a marker, as reference to which port it will be assembled into. To assemble the temperature plugs (block 905), each temperature tag may be cut to a desired size and mounted onto the underside of the appropriate plug, and the sealing element, such as the O-ring, and the retaining ring are installed. To install the O-ring, a dab of O-ring lubricant may be added to the internal diameter (ID) of the O-ring, and the O-ring can be carefully mounted onto the plug base from the bottom end side of the plug. A retaining ring may be installed as backup and positioned behind the O-ring towards the bottom end of the plug. Next, the extraction bolt is screwed into the screw hole (aperture) on the top of the plug. Each port is double-checked to ensure that it is clear of any debris/contamination (if not, it should be cleaned again). If temperature indicating paint is utilized, the user will confirm that the paint is dry before proceeding. To install the temperature plug into the port (block 906), a dab of O-ring lubricant is applied around the outer diameter (OD) of the O-ring. The temperature plug is then aligned and inserted into the port and tapped in lightly by utilizing a hammer and hitting on the extraction bolt end until fully seated. A snap ring tool (e.g., snap ring pliers) is used to squeeze and insert the snap ring into the pocket groove of the port (block 908). A small flat head (e.g., 1/16 or 3/32) may be used to assist with pushing the ring inside the pocket for the snap ring to fit. In the instance when trapped air from the sealing effect might push the plug slightly back off bottom, some push force might be required to fully expose the snap ring groove. The user may double-check that the snap ring is fully inside the groove, and test that the snap ring can move around freely in all areas. In some instances, the installation process may require some push on the plug due to seal effect still being present. Finally, a pull-out test may be conducted using small to moderate amounts of force to further test the proper seating of the snap ring. The pull-out test may involve positioning the extraction bolt into the threaded aperture of the temperature plug, with the snap ring installed, and pulling upward with the extraction bolt to confirm whether the snap ring is holding the temperature plug in place.

Figure 10:
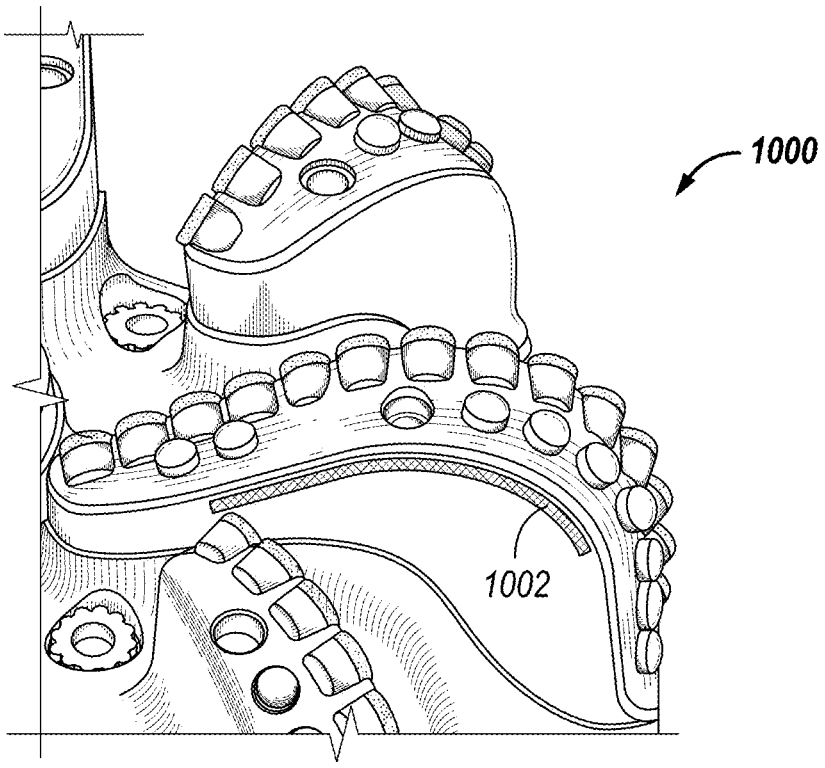
FIG. 10 is a partial perspective view of a PDC drill bit with temperature indicating paint on a blade of the drill bit, according to an exemplary embodiment.

In certain embodiments of the present application, at least a portion of the exterior of the drill bit may be coated with a temperature indicating paint (block 910). FIG. 10 shows an example of a drill bit frame 1000 that is partially coated with temperature indicating paint 1002. An exemplary method of the present application may include a method of painting at least a portion of the drill bit. Each blade of the drill bit may be cleaned with a solvent until no more debris is observed on cleaning cloth. The back of each blade may be painted, e.g., with a brush, with a temperature indicating paint and allowed to fully cure, typically 24 hours, before packaging for use downhole. This temperature indicating paint may provide additional information regarding the temperature exposure of different parts of the drill bit, for consideration along with information collected from the temperature plug(s).

Figure 11:
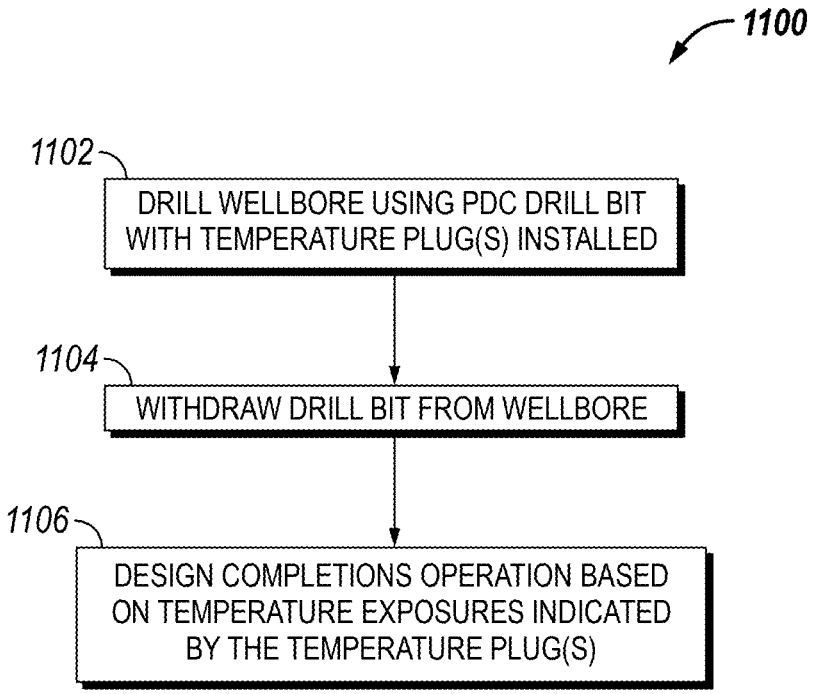
FIG. 11 is a process flow diagram illustrating a method of designing a completions operations plan, according to an exemplary embodiment.

Exemplary methods of the present application may also include a method of designing a completions operations plan based on the temperature exposures indicated on the temperature tags during drilling operations. FIG. 11 is a process flow diagram illustrating such a method 1100. At block 1102, the method 1100 includes drilling a wellbore using a PDC drill bit with one or more temperature plugs installed therein. At block 1104, the method 1100 includes withdrawing the drill bit from the wellbore for inspection of the temperature plug(s) and/or temperature indicating paint. At block 1106, the method 1100 includes designing a completions operation based on temperature exposures indicated by the temperature plug(s) and/or the temperature indicating paint. In particular, the method may include revising a completions material if $H_2S$ is determined to be a result of formation gasses. In certain embodiments, when the temperature tags and paint do not show any high temperatures to indicate generation of $H_2S$ during drilling, then one having ordinary skill in the art will recognize that the $H_2S$ is a result of formation gases, and NACE materials may be considered for the completions equipment. In addition, the topsides equipment for handling $H_2S$ at surface during production may be impacted. In some instances, the base case well design may be changed.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A temperature plug assembly, comprising:

a plug base having a first end, a second end opposite the first end, and an intermediate portion extending between the first end and the second end, wherein the plug base is a single, continuous piece; and a temperature indicator that is separate from the plug base and coupled to an external surface of the plug base proximate the first end of the plug base, wherein the temperature indicator faces outward from the plug base to display a temperature indication thereon, wherein the plug base comprises a recess formed in the first end of the plug base, wherein the temperature indicator is attached to the external surface of the plug base in the recess.

2. The temperature plug assembly of claim 1, further comprising a sealing element disposed around the intermediate portion of the plug base, wherein the sealing element is selected from the group consisting of O-rings, elastomers, and metal gaskets.

3. The temperature plug assembly of claim 1, further comprising a retainer ring disposed around the intermediate portion of the plug base.

4. The temperature plug assembly of claim 1, further comprising a snap ring configured to be selectively compressed from a radially expanded position into a radially compressed position, wherein the snap ring in the radially expanded position has an inner diameter smaller than an outer diameter of the second end of the plug base.

5. The temperature plug assembly of claim 1, further comprising an aperture extending from the second end of the plug base at least partially through the plug base.

6. The temperature plug assembly of claim 1, wherein the intermediate portion of the plug base comprises a groove about the body of the plug base such that the first end and the second end of the plug base extend further in a radial direction than the intermediate portion of the plug base away from a centerline of the plug base.

7. A drill bit, comprising:

a drill bit frame, wherein the drill bit frame comprises an opening formed directly therein, wherein the drill bit comprises a polycrystalline diamond compact (PDC) drill bit having polycrystalline diamond (PCD) cutters coupled to the drill bit frame, wherein a groove is formed into the drill bit frame along an edge of the opening in the drill bit frame; and a temperature plug positioned in the opening, the temperature plug comprising:

a plug base having a first end, a second end opposite the first end, and an intermediate portion extending between the first end and the second end;

a temperature indicator disposed along the first end of the plug base;

a snap ring disposed within the groove and directly abutting the second end of the plug base, thereby holding the temperature plug between the snap ring and an end of the opening within the drill bit frame.

8. The temperature plug assembly of claim 7, further comprising a sealing element disposed around the intermediate portion of the plug base and directly engaging an inner wall of the opening formed in the drill bit frame.

9. The temperature plug assembly of claim 8, wherein the sealing element is selected from the group consisting of O-rings, elastomers, and metal gaskets.

10. The drill bit of claim 7, wherein the temperature indicator comprises a temperature tag.

11. The drill bit of claim 7, further comprising temperature indicating paint coating a surface of the drill bit frame inside the opening, wherein the temperature indicating paint is separate from the temperature indicator, and wherein the temperature indicating paint is located between the temperature indicator on the first end of the plug base and an end of the opening within the drill bit frame.

12. The drill bit of claim 7, wherein the snap ring comprises a substantially flat surface on a side facing the temperature plug and a substantially flat surface on an opposite side facing away from the temperature plug.

13. The drill bit of claim 7, wherein the snap ring is a discontinuous ring with two ends proximate each other, wherein each end comprises a projection with a hole formed therethrough.

14. The drill bit of claim 7, wherein the drill bit frame comprises multiple blades, wherein the opening is formed in one of blades, wherein the blade in which the opening is formed has a nose portion, a shoulder portion, and a gage portion, wherein the opening is formed in the nose portion of the blade.

15. The drill bit of claim 7, further comprising multiple temperature plugs, wherein the drill bit frame comprises multiple openings formed directly therein, each temperature plug being positioned within a corresponding one of the openings in the drill bit frame.

16. The drill bit of claim 15, wherein at least two temperature plugs of the multiple temperature plugs are configured to detect temperatures within different temperature ranges from each other.

17. The drill bit of claim 7, further comprising at least one depth of cuts limiter disposed on the drill bit frame, wherein the temperature plug is located closer than the depth of cuts limiter to a center of the drill bit.

18. A method of manufacturing a drill bit, comprising:

providing a drill bit frame, the drill bit frame having an opening formed directly therein, wherein the drill bit comprises a polycrystalline diamond compact (PDC) drill bit having polycrystalline diamond (PCD) cutters coupled to the drill bit frame, wherein a groove is formed into the drill bit frame along an edge of the opening in the drill bit frame;

inserting a temperature plug in the opening, the temperature plug comprising:

a plug base having a first end, a second end opposite the first end, and an intermediate portion extending between the first end and the second end;

a temperature indicator disposed along the first end of the plug base; and inserting a snap ring into the groove such that the snap ring directly abuts the second end of the plug base, thereby holding the temperature plug between the snap ring and an end of the opening within the drill bit frame.

19. The method of claim 18, wherein the first end of the temperature plug enters the opening before the second end during insertion of the temperature plug in the opening.

20. The method of claim 18, further comprising applying temperature indicating paint to the drill bit frame.

21. The method of claim 18, wherein the temperature plug further comprises a sealing element disposed around the intermediate portion of the plug body, wherein the sealing element directly engages an inner wall of the opening formed in the drill bit frame when the temperature plug is inserted.

22. The method of claim 18, further comprising coating temperature indicating paint onto a surface of the drill bit frame inside the opening, wherein the temperature indicating paint is separate from the temperature indicator prior to inserting the temperature plug such that the temperature indicating paint is located between the temperature indicator on the first end of the plug base and an end of the opening within the drill bit frame upon insertion of the temperature plug.

23. A temperature plug assembly, comprising:

a plug base having a first end, a second end opposite the first end, and an intermediate portion extending between the first end and the second end, wherein the plug base is a single, continuous piece, and wherein the intermediate portion of the plug base comprises a groove about the body of the plug base such that the first end and the second end of the plug base extend further in a radial direction than the intermediate portion of the plug base away from a centerline of the plug base; and a temperature indicator that is separate from the plug base and coupled to an external surface of the plug base proximate the first end of the plug base, wherein the temperature indicator faces outward from the plug base to display a temperature indication thereon.

* * * * *